United States Patent [19]

Clevenger

[11] 4,210,181

[45] Jul. 1, 1980

[54] ADJUSTABLE PUMP NOZZLE LEVER PROP

[76] Inventor: Charles E. Clevenger, P.O. Box 151, Pensacola, Fla. 32504

[21] Appl. No.: 900,472

[22] Filed: Apr. 25, 1978

[51] Int. Cl.² ..... B65B 3/04; G05G 5/06

[52] U.S. Cl. ..... 141/392; 74/526; 141/DIG. 1; 248/354 P

[58] Field of Search ..... 74/526; 141/1, 392, 141/DIG. 1; 248/354 P, 356, 408, 409; 251/50, 111, 112, 284, 285

[56] References Cited

U.S. PATENT DOCUMENTS

| | | | |
|---|---|---|---|
| 1,890,423 | 12/1932 | Teagarden | 248/354 X |
| 2,800,931 | 7/1957 | Sutcliffe | 141/392 |
| 4,095,629 | 6/1978 | Jordan | 141/392 |

FOREIGN PATENT DOCUMENTS

| | | | |
|---|---|---|---|
| 2709085 | 9/1977 | Fed. Rep. of Germany | 248/354 P |

*Primary Examiner*—Frederick R. Schmidt

*Attorney, Agent, or Firm*—Clarence A. O'Brien; Harvey B. Jacobson

[57] ABSTRACT

First and second elongated members are provided including pairs of remote and adjacent ends. The adjacent ends of the members are supported from each other for relative longitudinal shifting of the members to extend and retract the remote ends thereof. Structure is provided for releasably securing the members in adjusted shifted positions and the remote ends of the members define endwise outwardly opening and transversely extending generally parallel notches for embracingly receiving the parallel trigger lever and trigger guard of a service station fuel supply hose nozzle when the elongated members are disposed therebetween.

5 Claims, 7 Drawing Figures

ADJUSTABLE PUMP NOZZLE LEVER PROP

BACKGROUND OF THE INVENTION

Many automotive service stations which vend gasoline and diesel fuel to motor vehicles have been, or are being, converted to "self-service" facilities wherein the purchaser of gasoline or diesel fuel operates the dispensing pump himself and pays the attendent after the desired amount of fuel has been dispensed into his motor vehicle.

Many of these "self-service" facilities are equipped with delivery nozzles which do not include automatically releasing catches for latching the delivery nozzle trigger levers in "open" positions. As a result, persons dispensing gasoline or diesel fuel into their own vehicles must continually maintain the spring biased trigger lever of the dispensing nozzle depressed in order to prevent premature termination of the dispensing of fuel from the nozzle when they wish to fill their fuel tanks. Accordingly, a need exists for a portable fuel nozzle trigger lever prop which may be interposed between the trigger lever of the nozzle and the adjacent parallel trigger guard portion of the nozzle in order to maintain the trigger lever depressed until the tank of the associated vehicle is substantially full.

While various forms of props have been heretofore provided, few, if any, have been specifically designed for use in conjunction with a fuel delivery nozzle. Further, many previously provided props are too great in length for use in a desired manner in conjunction with a fuel delivery nozzle and are not adjustable in length whereby the rate of fuel flow through the nozzle may be determined. Accordingly, the need for a prop to be utilized in conjunction with a fuel delivery nozzle includes the need for a short prop which is adjustable in length.

Various forms of props designed for different purposes and including some of the structural and operational features of the instant invention are disclosed in U.S. Pat. Nos. 118,698, 430,012, 932,162, 1,014,688 and 3,355,136.

BRIEF DESCRIPTION OF THE INVENTION

The prop of the instant invention invludes first and second elongated members including pairs of remote and adjacent ends. One of the adjacent ends defines an endwise outwardly opening recess in which the other adjacent end is slidingly telescopingly received. The elongated members have latch structure operatively associated therewith whereby they may be secured in adjusted extended positions relative to each other and the remote ends of the elongated members include endwise outwardly opening and transversely extending generally parallel notches for embracingly receiving the trigger lever and opposing trigger guard portion of a fuel delivery nozzle when the prop is interposed between the lever and guard portion.

The main object of this invention is to provide a short adjustable length prop for disposition between the trigger lever and opposing trigger guard portion of a fuel delivering nozzle.

Another object of this invention is to provide a prop in accordance with the preceeding object and including means whereby the effective length of the prop may be readily adjusted.

Still another object of this invention is to provide an adjustable length prop including remote end portions for embracingly engaging the associated trigger level and trigger guard portions.

Another important object of this invention is to provide a prop including means whereby it may be conveniently stored in an associated motor vehicle when not in use.

A final object of this invention to be specifically enumerated herein is to provide an adjustable length prop in accordance with the preceding objects and which will be conform to conventional forms of manufacture, be of simple construction and each to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
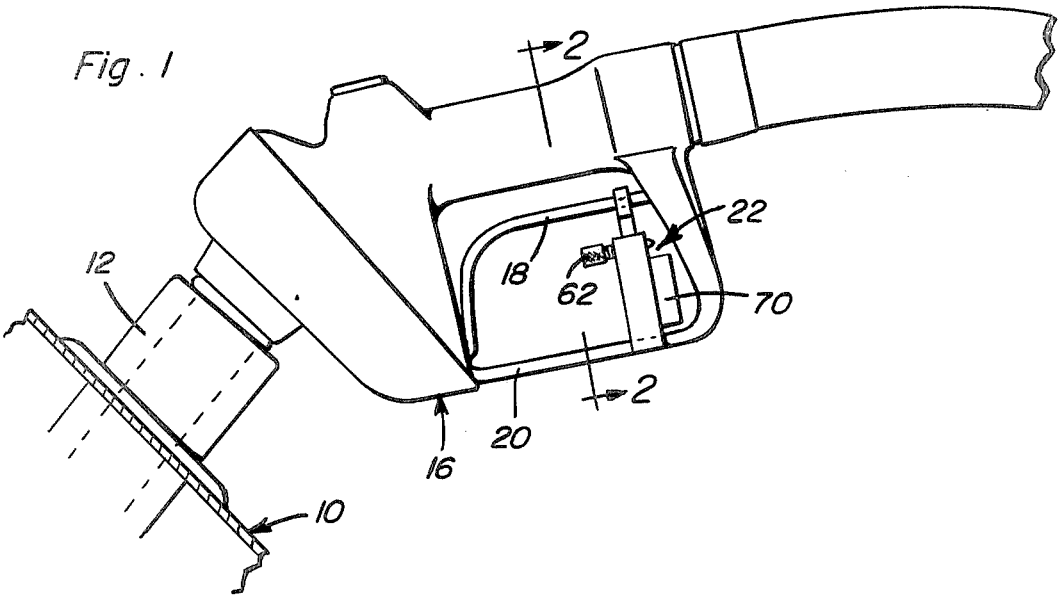
FIG. 1 is a side elevational view of a conventional form of automotive fuel delivery nozzle with the discharge end of the nozzle telescoped downwardly into the inlet neck of a fuel tank and with a prop constructed in accordance with the present invention operatively associated with the trigger lever and opposing trigger guard portion of the nozzle to maintain the trigger lever depressed.
Figure 2:
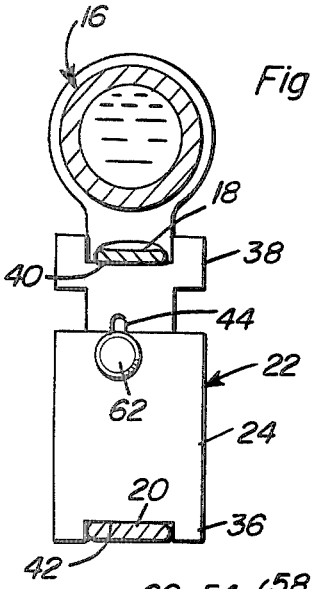
FIG. 2 is an enlarged vertical sectional view taken substantially upon the plane indicated by the section line 2—2 of FIG. 1.
Figure 3:
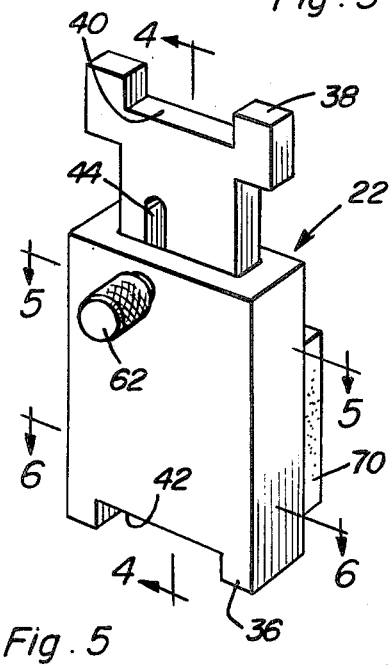
FIG. 3 is an enlarged perspective view of the prop.
Figure 4:
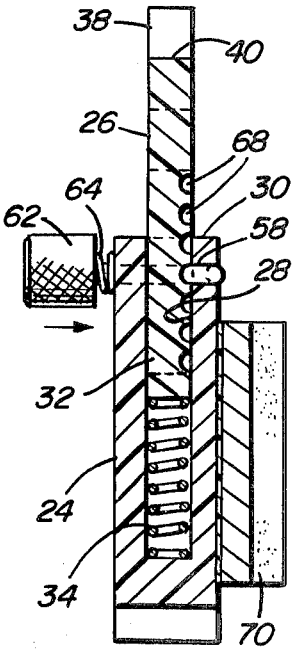
FIG. 4 is an enlarged vertical sectional view taken substantially upon the plane indicated by the section line 4—4 of FIG. 3.

Referring now more specifically to the drawings, the numeral 10 generally designates a vehicle including a fuel tank having an inlet neck 12 therefor closeable by means of a removable cap 14. The reference numeral 16 generally designates a conventional form of fuel delivery nozzle and the nozzle includes an oscillatable trigger lever 18 and an opposing trigger guard portion 20 which generally parallels the lever 18 and away from which the trigger lever 18 is shifted in order to open the nozzle 16.

The prop of the instant invention is referred to in general by the reference numeral 22 and includes a first and second elongated members 24 and 26. The elongated member 24 includes an elongated blind recess 28 opening endwise outwardly of one end 30 of the member 24 and one end 32 of the member 26 is slidingly telescoped into the recess 28. The inner end of the recess has a compression spring 34 seated therein and the end of spring 34 remote from the inner end of the recess 28 bears against the end 32 of the member 26 and thereby yieldingly biases the member 26 toward an extended position relative to the member 24.

The remote ends 36 and 38 of the members 24 and 26 have endwise outwardly opening transversely extending and parallel notches 40 and 42 formed therein and the member 26 is provided with an enlongated slot 44.

The member 24 includes a pair of aligned bores 46 and 48 with which the slot 44 is registered and the adjacent ends of the bores 46 and 48 open into the recess 28 while the remote ends of the bores 46 and 48 open outwardly of remote sides 50 and 52 of the member 24. A J-shaped latch 54 is provided including long and short legs 56 and 58 and a connecting portion 60 extending between and interconnecting one pair of corresponding ends of the legs 56 and 58. The long leg is slidingly received through the bores 46 and 48 and also the slot 44 and the free end of the long leg 56 projects outwardly from the side 50 of the member 24 and has an abutment 62 removably supported therefrom in spaced relation relative to the side 50. A compression spring 64 is disposed about the long leg 56 intermediate the side 50 and the abutment 62 and the side of the connecting portion 60 opposing the abutment 62 is abutted against the side 52 of the member 24.

The member 24 includes an additional bore 66 formed therein opening outwardly of the side 52 at one end and inwardly into the recess 28 at the other end. The member 26 includes longitudinally spaced outwardly opening recesses 68 selectively registrable with the inner end of the bore 66 and the short leg 58 of the latch 54 projects inwardly through the bore 66 and is seated in one of the recesses 68 and thereby retains the member 26 in adjusted extended position relative to the member 24. The side 52 of the member 24 includes a permanent magnet 70 supported therefrom whereby the prop 22 may be magnetically supported from the outer side 72 of the cap 14 when the prop 22 is not in use.

Figure 5:
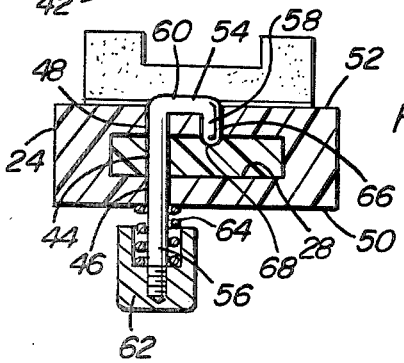
FIG. 5 is an enlarged horizontal sectional view taken substantially upon the plane indicated by the section line 5—5 of FIG. 3.
Figure 6:
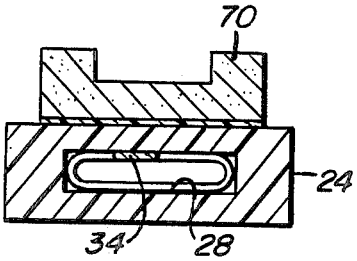
FIG. 6 is an enlarged horizonal sectional view taken substantially upon the plane indicated by the section line 6—6 of FIG. 3.

When the abutment 62 is depressed inwardly toward the side 50 of the member 24, the short leg 58 is withdrawn from the recess 68 registered with the inner end of the bore 66 and the member 26 may then be shifted longitudinally relative to the member 24 to adjust the length of the prop 22. Thereafter, the abutment 62 may be released whereupon the spring 64 will again return the latch 54 to the position thereof illustrated in FIG. 5 of the drawings with the free end of the short leg 58 seated in one of the recesses 68.

In operation, and assuming that the length of the prop 22 has been adjusted, the trigger lever 18 is displaced away from the trigger guard portion 20 in order to "open" the nozzle and the prop 22 is inserted between the lever 18 and the trigger guard portion 20 in position inclined approximately 45 degrees relative to the section line 2—2 in FIG. 1. Thereafter, the prop 22 is angularly displaced about a central transverse axis so as to swing the notched ends 36 and 38 into embracing engagement with the trigger guard portion 20 and the lever 18. In this position, the spring biased lever 18 will clamp the prop 22 in position between the lever 18 and the trigger guard portion 20 and the prop 22 will maintain the lever 18 in a partially or fully depressed position, as desired, in order to maintain the delivery of fuel through the nozzle 16 into the filler neck 12.

Figure 7:
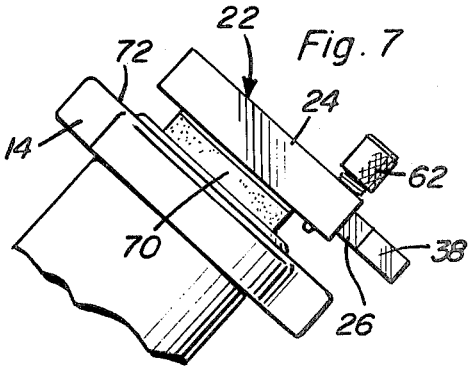
FIG. 7 is a fragmentary side elevational view of the inlet end of the neck of an automotive fuel tank with a closure cap secured over the inlet end of the neck and the prop of the instant invention magnetically supported from the outer end of the cap.

As soon as the desired amount of fuel has been dispensed into the neck 12, the prop 22 may be removed and the nozzle 16 may be withdrawn from the neck 12. Thereafter, the closure cap 14 is reinstalled over the inlet end of the neck 12 and the prop 22 may be magnetically attached to the closure cap 14 in the manner illustrated in FIG. 7 of the drawings. Inasmuch as most fuel inlet caps are disposed in positions not normally viewable, the magnetic mounting of the prop 22 on the closure cap 14 will not be objectionable from an aesthetic standpoint.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An adjustable prop for insertion between the trigger lever of a gasoline or diesel oil delivery hose nozzle and the trigger lever guard of the nozzle, said prop including first and second elongated members including pairs of remote and adjacent ends, said adjacent ends of said members being supported relative to each other for relative longitudinal shifting of said members between lengthwise extended and retracted positions of said remote ends, means operative to releasably secure said members in adjusted shifted positions, means defining endwise outwardly opening and transversely extending generally parallel notches in said remote ends for embracingly receiving said lever and guard when said prop is interposed therebetween, one of said adjacent ends defining an endwise outwardly opening recess in which the other adjacent end is telescopingly engaged, said other adjacent end including a longitudinal slot, a J-shaped latch pin including generally parallel long and short legs joined at one pair of corresponding ends by means of a connecting member extending therebetween, said one adjacent end having one pair of transverse aligned bores formed therein opening inwardly into said recess from opposite sides thereof and aligned with said slot, said long leg extending through said bores and being slidingly received in said slot with the end of said long leg remote from said connecting portion projecting outwardly from one side of said one adjacent end and having an abutment supported therefrom, a compression spring disposed about said long leg intermediate said abutment and said one side of said one adjacent end, said connecting portion extending transversely of said slot outwardly of the other side of said one adjacent end, said one adjacent end including an additional bore formed therein paralleling said pair of bores and opening into said recess at one end and outwardly of said other side at the other end thereof, said short leg extending inwardly through said additional bore from said other side and projecting slightly into said recess, said other adjacent end portion including longitudinally spaced outwardly opening recesses formed therein selectively registrable with the inner end of said additional bore and in one of which recesses the free end of said short leg is received for retaining said members in adjacent shifted positions, said free end of said short leg being retractable outwardly of said recess upon inward displacement of said abutment toward said one side against the biasing action of said spring.

2. The combination of claim 1 wherein said prop includes a permanent magnet supported therefrom.

3. In combination with a service station fuel supply hose nozzle of the type including a trigger lever and a trigger guard generally paralleling said lever, a prop for disposition between said lever and guard, said prop including first and second elongated members including pairs of remote and adjacent ends, said adjacent ends of said members being supported relative to each other for relative longitudinal shifting of said members between lengthwise extended and retracted positions of said remote ends, means operative to releasably secure said members in adjusted shifted positions, means defining endwise outwardly opening transversely extending generally parallel notches in said remote ends for embracingly receiving said lever and guard when said prop is interposed therebetween, one of said adjacent ends defining an endwise outwardly opening recess in which the other adjacent end is telescopingly engaged, said other adjacent end including a longitudinal slot, a J-shaped latch pin including generally parallel long and short legs joined at one pair of corresponding ends by means of a connecting member extending therebetween, said one adjacent end having one pair of transverse aligned bores formed therein opening inwardly into said recess from opposite sides thereof and aligned with said slot, said long leg extending through said bores and being slidingly received in said slot with the end of said long leg remote from said connecting portion projecting outwardly from one side of said one adjacent end and having an abutment supported therefrom, a compression spring disposed about said long leg intermediate said abutment and said one side of said one adjacent end, said connecting portion extending transversely of said slot outwardly of the other side of said one adjacent end, said one adjacent end including an additional bore formed therein paralleling said pair of bores and opening into said recess at one end and outwardly of said other side at the other end thereof, said short leg extending inwardly through said additional bore from said other side and projecting slightly into said recess, said other adjacent end portion including longitudinally spaced outwardly opening recesses formed therein selectively registrable with the inner end of said additional bore and in one of which recesses the free end of said short leg is received for retaining said members in adjusted shifted positions, said free end of said short leg being retractable outwardly of said recess upon inward displacement of said abutment toward said one side against the biasing action of said spring.

4. The combination of claim 3 wherein said prop includes a permanent magnetic supported therefrom.

5. In combination with a service station fuel supply hose nozzle of the type including a trigger lever and a trigger guard generally paralleling said lever, a prop for disposition between said lever and guard, said prop including first and second elongated members including pairs of remote and adjacent ends, said adjacent ends of said members being supported relative to each other for relative longitudinal shifting of said members between lengthwise extended and retracted positions of said remote ends, means operative to releasably secure said members in adjusted shifted positions, means defining endwise outwardly opening and transversely extending generally parallel notches in said remote ends for embracingly receiving said lever and guard when said prop is interposed therebetween, one of said adjacent ends defining an endwise outwardly opening recess in which the other adjacent end is telescopingly engaged, said other adjacent end including a longitudinal slot, said one adjacent end having an elongated latch pin supported therefrom for lengthwise shifting between first and second latching and unlatching positions and extending transversely through said recess and slidably received in said slot, means connected between said pin and one adjacent end yieldingly biasing said pin toward said first position, said pin and other adjacent end including coacting portions locking said first and second members in predetermined relatively extended positions when said pin is in said first position and inoperative to lock said first and second members in adjusted relatively extended position when said pin is in said second position, said pin extending transversely through said recess and being slidably received in said slot when said pin is in said first and second positions and all intermediate positions therebetween.

* * * * *